US007695535B2

(12) United States Patent
Dunlop

(10) Patent No.: US 7,695,535 B2
(45) Date of Patent: Apr. 13, 2010

(54) PROCESS FOR IN-SITU PASSIVATION OF PARTIALLY-DRIED COAL

(75) Inventor: Donald D. Dunlop, Miami, FL (US)

(73) Assignee: River Basin Energy, Inc., Highlands Ranch, CO (US)

( * ) Notice: Subject to any disclaimer, the term of this patent is extended or adjusted under 35 U.S.C. 154(b) by 1111 days.

(21) Appl. No.: 11/316,508

(22) Filed: Dec. 22, 2005

(65) Prior Publication Data

US 2006/0096167 A1 May 11, 2006

Related U.S. Application Data

(63) Continuation-in-part of application No. 10/978,768, filed on Nov. 1, 2004, now Pat. No. 7,537,622, and a continuation-in-part of application No. 09/974,320, filed on Oct. 10, 2001, now abandoned.

(51) Int. Cl.
*C10L 5/00* (2006.01)

(52) U.S. Cl. ..... 44/626; 44/620

(58) Field of Classification Search ..... 44/620, 44/626

See application file for complete search history.

(56) References Cited

U.S. PATENT DOCUMENTS

| | | | |
|---|---|---|---|
| 1,632,829 | A | 6/1927 | Fleisnner |
| 1,960,917 | A | 5/1934 | Nagelvoort |
| 2,197,792 | A | 4/1940 | Erickson |
| 2,204,781 | A | 6/1940 | Wattles |
| 2,610,115 | A | 9/1952 | Lykken |
| 2,811,427 | A | 10/1957 | Lykken |

(Continued)

FOREIGN PATENT DOCUMENTS

| | | |
|---|---|---|
| CA | 959783 | 12/1974 |

OTHER PUBLICATIONS

U.S. Appl. No. 12/566,174, filed Sep. 24, 2009, Dunlop et al.

*Primary Examiner*—Cephia D Toomer
(74) *Attorney, Agent, or Firm*—Sheridan Ross P.C.

(57) ABSTRACT

Thus, a novel process for producing a passivated coal material has been disclosed, comprising the steps of (a) drying a coal material by heating said coal material in the presence of a first gas comprised of less than about five volume percent of oxygen until said coal material has a moisture content of from above about 1 to about 20 weight percent, thereby producing a partially dried coal material, wherein said coal material is selected from the group consisting of lignitic coal, sub-bituminous coal, bituminous coal, coal char, and mixtures thereof; (b) heating said partially dried coal material to a temperature of from about 100 to about 600 degrees Fahrenheit, thereby producing a heated partially dried coal material; (c) charging said heated partially dried coal material to a fluidized bed reactor; (d) feeding a second gas with an oxygen content of from about 6 to about 15 volume percent into said fluidized bed reactor; (e) contacting said heated partially dried coal material with said second gas while maintaining said heated partially dried coal material at a temperature of from about 450 to about 650 degrees Fahrenheit; and, thereafter, (f) removing water from said heated partially dried coal material until no more than about 1 weight percent of water remains in said heated partially dried coal material.

20 Claims, 6 Drawing Sheets

U.S. PATENT DOCUMENTS 3,047,473 A 7/1962 Schmidt
3,424,573 A 1/1969 De Villiers
3,687,431 A 8/1972 Parks
3,723,079 A 3/1973 Seitzer
3,896,557 A 7/1975 Seitzer
3,961,914 A 6/1976 Kindig
3,971,639 A 7/1976 Matthews
3,985,516 A 10/1976 Johnson
3,985,517 A 10/1976 Johnson
3,997,422 A 12/1976 Bull et al.
4,043,763 A 8/1977 Norman
4,045,187 A 8/1977 Brink et al.
4,052,169 A 10/1977 Cole
4,071,151 A 1/1978 Farber
4,104,035 A 8/1978 Cole et al.
4,140,228 A 2/1979 Hathaway
4,142,868 A 3/1979 Gencsoy
4,149,228 A 4/1979 Adamson, Jr.
4,170,456 A 10/1979 Smith
4,192,650 A 3/1980 Seitzer
4,203,727 A 5/1980 Simpson
4,213,752 A 7/1980 Seitzer
4,214,875 A 7/1980 Kromrey
4,226,371 A 10/1980 Willams
4,244,530 A 1/1981 Halvorsen
4,249,909 A 2/1981 Comolli
4,282,006 A 8/1981 Funk
4,300,291 A 11/1981 Heard et al.
4,301,746 A 11/1981 Pech et al.
4,309,192 A 1/1982 Kubo et al.
4,314,898 A 2/1982 Nakako et al.
4,324,544 A 4/1982 Blake
4,329,929 A 5/1982 Jessen
4,341,530 A 7/1982 Loth
4,353,427 A 10/1982 Stock
4,430,963 A 2/1984 Finet
4,444,129 A 4/1984 Ladt
4,452,688 A 6/1984 Mitchell et al.
4,455,148 A 6/1984 Nagata et al.
4,461,624 A 7/1984 Wong
4,468,232 A 8/1984 Funk
4,470,878 A 9/1984 Petrovic et al.
4,486,894 A 12/1984 Page
4,495,710 A 1/1985 Ottoson
4,497,122 A 2/1985 Nelson
4,504,277 A 3/1985 Scheffee
4,510,040 A 4/1985 Skinner et al.
4,519,995 A 5/1985 Schrofelbauer et al.
4,529,407 A 7/1985 Johnston et al.
4,547,282 A 10/1985 Schindler
4,562,748 A 1/1986 Mrochek et al.
4,563,196 A 1/1986 Seipenbusch
4,571,174 A 2/1986 Shelton
4,575,418 A 3/1986 Robbins
4,596,650 A 6/1986 Schindler et al.
4,606,793 A 8/1986 Petrovic et al.
4,617,744 A 10/1986 Siddoway et al.
4,795,037 A 1/1989 Rich, Jr.
4,852,384 A 8/1989 Woolbert
5,003,891 A 4/1991 Kaneko et al.
5,030,054 A 7/1991 Reschly
5,033,208 A 7/1991 Ohno et al.
5,035,721 A 7/1991 Atherton
5,050,310 A 9/1991 Jiles
5,054,697 A 10/1991 Provost
5,087,269 A 2/1992 Cha
5,103,743 A 4/1992 Berg
5,145,489 A 9/1992 Dunlop
5,156,686 A 10/1992 Van Slyke
5,162,265 A 11/1992 Roth
5,171,474 A 12/1992 Tono
5,174,799 A 12/1992 Garcia-Mallol
5,197,398 A 3/1993 Levy
5,199,185 A 4/1993 Davidson
5,213,635 A 5/1993 Huang
5,215,596 A 6/1993 Van Slyke
5,234,577 A 8/1993 Van Slyke
5,265,774 A 11/1993 Stone
5,269,947 A 12/1993 Baskis
5,327,717 A 7/1994 Hauk
5,360,553 A 11/1994 Baskis
5,361,513 A 11/1994 Woessner
5,387,267 A 2/1995 Warf et al.
5,396,260 A 3/1995 Adel
5,411,560 A 5/1995 Mainwaring
5,442,919 A 8/1995 Wilhelm
5,444,733 A 8/1995 Coassin
5,462,932 A 10/1995 Brenner
5,471,955 A 12/1995 Dietz
5,477,850 A 12/1995 Zegler
5,503,646 A 4/1996 McKenny
5,517,930 A 5/1996 Farwick et al.
5,521,132 A 5/1996 Talmy
5,527,365 A 6/1996 Coleman
5,534,127 A 7/1996 Sakai
5,534,137 A 7/1996 Griggs
5,537,941 A 7/1996 Goidich
5,543,061 A 8/1996 Baskis
5,546,875 A 8/1996 Selle
5,547,549 A 8/1996 Fraas
5,556,436 A 9/1996 Yagaki et al.
5,562,884 A 10/1996 Oakes
5,568,896 A 10/1996 Adams
5,587,085 A 12/1996 Yoon et al.
5,601,692 A * 2/1997 Rinker et al. ..... 201/9
5,612,003 A 3/1997 Heumann
5,625,119 A 4/1997 Tischler
5,637,336 A 6/1997 Kannenberg et al.
5,830,246 A 11/1998 Dunlop
5,830,247 A 11/1998 Dunlop
5,832,848 A 11/1998 Reynoldson et al.
5,858,035 A 1/1999 Dunlop
5,904,741 A 5/1999 Dunlop
6,146,432 A 11/2000 Ochs
6,162,265 A 12/2000 Dunlop
7,537,622 B2 5/2009 Dunlop et al.

* cited by examiner

PROCESS FOR IN-SITU PASSIVATION OF PARTIALLY-DRIED COAL

CROSS-REFERENCE TO RELATED PATENT APPLICATION

This application is a continuation-in-part of applicant's patent application Ser. No. 09/974,320, filed on Oct. 10, 2001, now abandoned and 10/978,768 filed on Nov. 1, 2004, now U.S. Pat. No. 7,537,622. The entire disclosures of these applications are hereby incorporated by reference into this specification.

FIELD OF THE INVENTION

A process for in-situ passivation of partially dried coal in a fluidized bed reactor.

BACKGROUND OF THE INVENTION

Several United States patents have issued to the applicant for drying coal in a fluidized bed reactor. These include U.S. Pat. No. 5,830,246 ("Process for processing coal"), U.S. Pat. No. 5,830,247("Process for processing coal"), U.S. Pat. No. 5,858,035 ("Process for processing coal"), U.S. Pat. No. 5,904,741 ("Process for processing coal"), and U.S. Pat. No. 6,162,265 ("Process for processing coal"). The entire disclosure of each of these United States patents is hereby incorporated by reference into this specification.

With increasing energy demands, and increasing energy production costs, there is a need for efficient production methods for upgrading low rank or "wet" coal products to consumable energy products. Many researchers have devoted significant resources to developing these processes and technologies.

The coal industry has faced excessive transportation costs for these moisture-laden low-rank coal products. However, while drying coal to a low moisture content prior to shipment offers significant advantages in terms of reduced transportation costs, it renders the coal subject to spontaneous combustion during shipment and storage. Significant inflagration and explosion hazards are created, exposing workers and emergency responders to dangerous conditions.

The problem of spontaneous combustion of coal has been well known for more than half a century. Sub-bituminous, bituminous, lignite, brown coal and coal char can spontaneously combust by chemical reactions between the coal, moisture and oxygen present in the air. This reaction can occur when water combining with other components in the coal generate a sufficient amount of heat to raise the temperature of the coal to the ignition point. Additionally, noncarbonaceous or unsaturated carbon compound materials present in the coal may oxidize upon exposure to air, which in turn generates a sufficient amount of heat for the coal to reach ignition temperature.

U.S. Pat. No. 4,170,456 (Inhibiting spontaneous combustion of coal char) explains that, "Spontaneous combustion occurs when the rate of heat generation from oxidation exceeds the rate of heat dissipation. Previous workers have found that the reason spontaneous combustion does not occur more often than it does is that the oxidation rate of coal char decreases with the increasing time of or extent of oxidation. Therefore, when coal char is exposed to oxygen, a race begins between the effects of high temperature coefficient of oxidation rate and the decreasing rate of oxidation as oxygen is consumed by the coal char. Depending on the winner, spontaneous combustion occurs or doesn't occur." The entire disclosure of each of these United States patents is hereby incorporated by reference into this specification.

Commonly used drying processes utilize a hot combustion gas to drive moisture from the coal in a bed of coal, a fluidized bed, a kiln or a rotary device. Conventional drying methods often center around pyrolysis and result in a coal product which is active and subject to self-heating by the processes described above.

U.S. Pat. No. 6,146,432 (Pressure gradient passivation of carbonaceous material normally susceptible to spontaneous combustion) explains "Low-rank coals, such as sub-bituminous coal or lignite may contain more than about 10% moisture and typically 15-50 weight percent moisture. Some low-rank coals may contain as much as 60 weight percent moisture. Such wet low-rank coals cannot be shipped economically over great distances due to the cost of transporting a significant fraction of unusable material in the form of water. Further, these low-rank coals cannot be burned efficiently due to the energy required to vaporize the water. Due to the lowered heating value and high cost of shipping unusable material, it is advantageous to remove all or part of the water from the low-rank coals prior to shipment and/or storage. However, drying such fuels usually leads to activation of the low-rank coals or chars. The reactive coals or chars may be hazardous due to the potential for damage to property or life due to the reaction of the coal or char with atmospheric oxygen and moisture and consequential heating of the coal, which makes it subject to spontaneous ignition during either shipment or storage. Indicators of the propensity of coals or chars to spontaneously combust include the uptake of oxygen as measured in terms of torr of oxygen per gram of material. Methods for testing this indicator are listed in U.S. Bureau of Mines "Report of Investigation 9330" by Miron, Smith, and Lazzara. The terms "oxygen uptake" and "oxygen demand" refer to the test methods of the "Report of Investigation 9330" or related test methods when used in this document. In the past, wet low-rank coals such as those from the western United States have been dried by methods such as, but not limited to, thermal drying using process heat, waste heat, microwaves, pressurized water, steam, hot oil, molten metals, and other supplies of high temperatures. The heated coals release the free moisture trapped in the pores, water molecules associated with hydrated molecules or associated in other ways with the coal, producing dried coals or chars. Other methods of drying may include mechanical drying (such as centrifugal separation), the use of dry gases, or the use of desiccants or absorbents. Once dried, coals or chars can become more active and are known to spontaneously combust." The entire disclosure of said United States patent is hereby incorporated by reference into this specification.

Many researches have devoted significant resources to address this problem, some of which will be briefly described. None of the approaches, and in particular, those utilizing an oxygenated environment, have realized commercial success.

To reduce the potential for the spontaneous combustion of coal, approaches have focused on filming or coating the surface of the coal with deactivating fluids to seal it using oils, polymers, tars, waxes or other hydrocarbon materials. Reference is made, e.g., to U.S. Pat. No. 1,960,917 (Process for treating coal), U.S. Pat. No. 2,197,792 (Coal spraying chute), U.S. Pat. No. 2,204,781 (Art of protecting coal and like), U.S. Pat. No. 2,610,115 (Method for dehydrating lignite) and U.S. Pat. No. 2,811,427 (Lignite fuel). U.S. Pat. No. 3,961,914 (Process for treating coal to make it resistant to spontaneous combustion) disclosed a silicon dioxide film on the coal surface. The entire disclosure of each of these United States patents is hereby incorporated by reference into this specification. Without wishing to be bound by any particular theory, applicants believe that favorable altering of the surface components reduces the reactivity and oxidation.

Other methods have used application of oxidizing agents or treatment with high temperature under pressure (U.S. Pat. No. 6,146,432 at column 2, lines 35-60). The entire disclosure of each of these United States patents is hereby incorporated by reference into this specification. Yet other processes use controlled drying in a manner that particle surface pores are self-sealed by hydrocarbon material evolved from the particles.

Other approaches include the prolonged exposure of the coal to air, the use of oxidizing agents sprayed on coal, and treating the coal with high-temperature water under pressure. The coatings perform their work by covering the pores and limiting the access of active components of the air to active sites on the dried coal. U.S. Pat. No. 3,723,079 (Stabilization of coal) explains: "For example, coal piles are often arranged in a particular manner to obtain safe storage; e.g., thin layers which are compacted with sloping sides at a maximum angle of 14°, smooth final surfaces, and top surface continually smoothed as coal is removed from the top only. Other approaches to prevent spontaneous combustion during storage involves chemical treatment of the coal, e.g., coating the coal with petroleum products and their emulsions, spraying with calcium bicarbonate or aqueous hydroquinone or amines. Such treatments, however, are either not completely effective or are excessively expensive for a low prices commodity such as coal." The entire disclosure of such United States patent is hereby incorporated by reference into this specification.

U.S. Pat. No. 3,985,516 (Coal drying and passivation process) and U.S. Pat. No. 3,985,517 (Coal passivation process) disclose mixing of coal in a fluidized bed with at least 0.5 weight percent of hydrocarbon material during the heating process. These coatings are effective in preventing reabsorption of moisture, however, such coatings are expensive due to the cost of the added hydrocarbon materials. The entire disclosure of said United States patent is hereby incorporated by reference into this specification.

U.S. Pat. No. 1,632,829 (Method of drying coal and the like) describes a process for drying wet coal by steam heating it. In the method described, steam disposed above the coal is maintained at high partial pressure to prevent escape of the moisture while the coal temperature elevates. Thereafter, the steam pressure is reduced, permitting the escape of moisture and rapid drying of the coal. The entire disclosure of said United States patent is hereby incorporated by reference into this specification.

U.S. Pat. No. 4,052,169 (Treatment of solid fuels) describes a process for upgrading lignitic coal by heating it in an autoclave at about 750° F. and pressures in excess of 1000 psig to effect thermal restructuring. Thereafter the coal is cooled and condensable organic material is deposited on the lignite, stabilizing it and render it non-hygroscopic and more resistant to weathering and oxidation during shipment and storage. It is believed that the use of high temperature water drives off carboxylic acid groups and rendering those sites inactive to future activity with the active components of the fluid. The entire disclosure of said United States patent is hereby incorporated by reference into this specification.

U.S. Pat. No. 4,214,875 (Coated coal piles) disclosed a coating composition to be applied to a pile of coal exposed to the weather in order to exclude rain and air by forming a continuous covering over the pile. The composition was normally thixotropic and included wax, tar or pitch or a polymer which provided a covering from one-quarter inch to one inch thick. It was necessary to break the covering in order to transfer or utilize the coal. The entire disclosure of said United States patent is hereby incorporated by reference into this specification.

Berkowitz in Canadian patent 959783, described a method of treating low-rank coals which included heating the coal to a temperature (about 350° C.) by immersion in a liquid medium, causing pyrolytic material to diffuse from the interior to the surface of the coal particles and to plug to pores to prevent moisture reabsorption. The entire disclosure of said Canadian patent is hereby incorporated by reference into this specification.

Wong disclosed in U.S. Pat. No. 4,461,624 (Beneficiation of low-rank coals by immersion in residuum) a process of immersing coal in residuum having a softening point of at least 80° C., at a temperature from about 240° C. to the decomposition temperature to boil off the moisture content and coat the coal particles within the immersion medium. This process has the disadvantages of providing a thick coating of treatment material on the coal particles which must be drained off of the particles." The entire disclosure of said United States patent is hereby incorporated by reference into this specification.

U.S. Pat. No. 6,146,432 (Pressure Gradient Passivation of Carbonaceous Material Normally Susceptible to Spontaneous Combustion) describes a process for the passivation of a carbonaceous material by exposure to an oxygenated gas over a pressure gradient. The entire disclosure of said United States patent is hereby incorporated by reference into this specification.

U.S. Pat. No. 4,170,456 (Inhibiting spontaneous combustion of coal char) discloses a treatment with air and carbon dioxide at temperatures from 50° F. to 300° F. to deactivate the surface of the coal char. The entire disclosure of said United States patent is hereby incorporated by reference into this specification.

U.S. Pat. No. 4,192,650 (Process for drying and stabilizing coal) discloses a treatment that rehydrates the coal to a moisture level of 2-10 weight percent. The entire disclosure of said United States patent is hereby incorporated by reference into this specification.

U.S. Pat. No. 5,527,365 (Irreversible drying of carbonaceous fuels) discloses a method for drying coal in a mildly reducing lower alkane gaseous atmosphere at a temperature of 150° to 300° C., with or without agglomeration with small amounts of oil. The entire disclosure of said United States patent is hereby incorporated by reference into this specification.

U.S. Pat. No. 4,213,752 (Coal drying process) discloses a single-step process using in-situ generated thermal energy and causing partial combustion of the coal at atmospheric pressure in the presence of gas such as atmospheric air. The entire disclosure of said United States patent is hereby incorporated by reference into this specification.

U.S. Pat. No. 4,043,763 (stabilization of dried coal) discloses a process of combining completely or partially dried coal with as-mined coal in a weight ratio of 1:2 to 10:1. The entire disclosure of said United States patent is hereby incorporated by reference into this specification.

U.S. Pat. No. 3,723,079 (Stabilization of coal) discloses a process of treating dried coal with 0.5-8% oxygen by weight at a temperature of 175° C. to 225° C. and rehydrating the coal with water of from 1.5%-6% by weight of oxygen treated coal. The entire disclosure of said United States patent is hereby incorporated by reference into this specification.

U.S. Pat. No. 4,249,909 (Drying and passivating wet coals and lignite) discloses a staged process of heating under low partial pressure of moisture to 8-12% moisture content then heated to a lower differential vapor pressure to remove additional moisture. The entire disclosure of said United States patent is hereby incorporated by reference into this specification.

U.S. Pat. No. 3,896,557 (Process for drying and stabilizing coal) discloses a process of heating the coal in a fluidized combustion gas streat containing 7-9% by volume of oxygen to reduce moisture content to 8-12% by volume. The entire disclosure of said United States patent is hereby incorporated by reference into this specification.

The novel process described in this patent application provides a process for reducing the predisposition of coal to self-heat in the presence of oxygen. This novel, cost-effective and efficient process for irreversible drying and passivation of coal combines the advantages of the coating technology with the exposure of the coal to an oxygenated environment.

While the process taught in U.S. Pat. No. 6,146,432 requires a gradient of pressures, the novel process herein described can be done at atmospheric pressure and moderate temperatures in the range of 450-650 degrees Fahrenheit. U.S. Pat. No. 5,527,365 (Irreversible drying of carbonaceous fuels) teaches that processes involving high temperatures and pressures are economically undesirable, require substantial energy and capital investments and present inherent risks and dangers. The production costs are increased by specialized expensive equipment, apparatuses and facilities. The entire disclosure of said United States patent is hereby incorporated by reference into this specification.

U.S. Pat. No. 4,213,752 (Coal drying process) discloses advantages that are shared by the present invention through a new and novel process, "The process of the invention has the additional benefit that it is less costly because it uses the in-situ generated thermal energy for drying the added wet coal. This results from the fact that no capital investment is needed. Also, the system of the invention allows greater flexibility in the degree to which coal drying is made to occur because the coal stability is not critically sensitive to a particular moisture level and thus the product coal is very highly stable totally dry or with various moisture levels. Still further there is no need in the process of the invention for a rehydrating step which some prior art processes require to obtain a stabilized coal." The entire disclosure of said United States patent is hereby incorporated by reference into this specification.

SUMMARY OF THE INVENTION

In its broadest context, a preferred embodiment of the present invention consists of a process where partially dried coal material, previously dried in an inert environment to a moisture content of about 0.01 to about 20 weight percent, is irreversibly dried and passivated by heating the partially dried coal material in a fluidized bed with fluidized combustion gases containing from about 6 to about 15 weight percent oxygen until the moisture content of said coal material is from about 0.01 to about 1% water by weight. Such process steps may be individually configured and correlated with respect to each other so as to attain desired objective. The process of the present invention may be carried out by conventional techniques using a fluidized bed or introduction of the oxygenated gas at the base of the pile of char. After treatment, the coal may be handled, transported or stored without fear of spontaneous combustion.

Thus having broadly outlined the more important features of the present invention in order that the detailed description thereof may be better understood, and that the present contribution to the art may be better appreciated, there are, of course, additional features of the present invention that will be described herein and will form a part of the subject matter of the claims appended to this specification.

In this respect, before explaining at least one embodiment of the invention in detail, it is to be understood that the invention is not limited in its application to the details and the arrangements of the process steps set forth in the following description or illustrated in the drawings. The present invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is to be understood that the aforementioned description is illustrative only and that changes can be made in the apparatus, in the ingredients and their proportions, and in the sequence of combinations and process steps, as well as in other aspects of the invention discussed herein, without departing from the scope of the invention as defined in the following claims. It is important, therefore, that the claims be regarded as including such equivalent construction insofar as they do not depart from the spirit and scope of the conception regarded as the present invention.

It is thus an object of this invention is to provide a process to reduce the ability of coal to spontaneously combust thereby rendering such coal amenable to normal transport and handling procedures.

It is also an object of the present invention to provide a coal passivation process that is susceptible of low manufacturing costs with regard to labor and materials, and which accordingly then produces a coal based energy product susceptible of low prices for the consuming public, thereby making it economically available to the buying public.

Another object of this invention is to provide a means for stabilizing bituminous, sub-bituminous coal, coal char, brown coal or lignite coal to improve the safety and economics for using such coals.

These and other objectives of the invention, which will become apparent from the following description, have been achieved by a novel process for producing a passivated coal material, comprising the steps of (a) drying a coal material by heating said coal material in the presence of a first gas comprised of less than about five volume percent of oxygen until said coal material has a moisture content of from about 0.01 to about 20 weight percent, thereby producing a partially dried coal material, wherein said coal material is selected from the group consisting of lignitic coal, sub-bituminous coal, bituminous coal, coal char, and mixtures thereof; (b) heating said partially dried coal material to a temperature of from about 100 to about 600 degrees Fahrenheit, thereby producing a heated partially dried coal material; (c) charging said heated partially dried coal material to a fluidized bed reactor; (d) feeding a second gas with an oxygen content of from about 6 to about 15 volume percent into said fluidized bed reactor; (e) contacting said heated partially dried coal material with said second gas while maintaining said heated partially dried coal material at a temperature of from about 450 to about 650 degrees Fahrenheit; and, thereafter, (f) removing water from said heated partially dried coal material until no more than about 1 weight percent of water remains in said heated partially dried coal material.

In a preferred embodiment of this process, the residence time of the coal is from about 4 to about 7 minutes. The process may take place at a temperature from about 450-650 degrees Fahrenheit. Preferably, the process takes place at a temperature from about 500 degrees Fahrenheit to about 550 degrees Fahrenheit. The pressure may be atmospheric pressure to about 1000 psig.

This novel process is particularly beneficial for finely divided particles of lower rank coals with greater surface area and greater tendency to spontaneously ignite. The coal may include, but is not limited to coal, low-rank coal, dried coal, peat, char, or other porous solid fuel. Preferably, the carbonaceous material is bituminous, sub-bituminous or lignitic coal or char. The carbonaceous material may contain from about 0.1 weight percent to about 65 weight percent of moisture.

The drying method of this invention can be accomplished either in (a) batch-wise manner in a fluidized bed in which conditions are changed successively, or (b) continuously be mechanically moving the material through the successive drying steps, such as by a moving belt or screw conveyor. A continuous drying procedure is preferred for large capacity commercial drying applications for coal or lignite, such as those exceeding about 500 tons/day.

Whereas there may be many embodiments of the present invention, each embodiment may meet one or more of the foregoing recited objects in any combination. It is not intended that each embodiment will necessarily meet each objective.

BRIEF DESCRIPTION OF THE DRAWINGS

The invention will be described by reference to the specification and the drawings, in which like numerals refer to like elements, and wherein.

DESCRIPTION OF THE PREFERRED EMBODIMENTS

Figure 1:
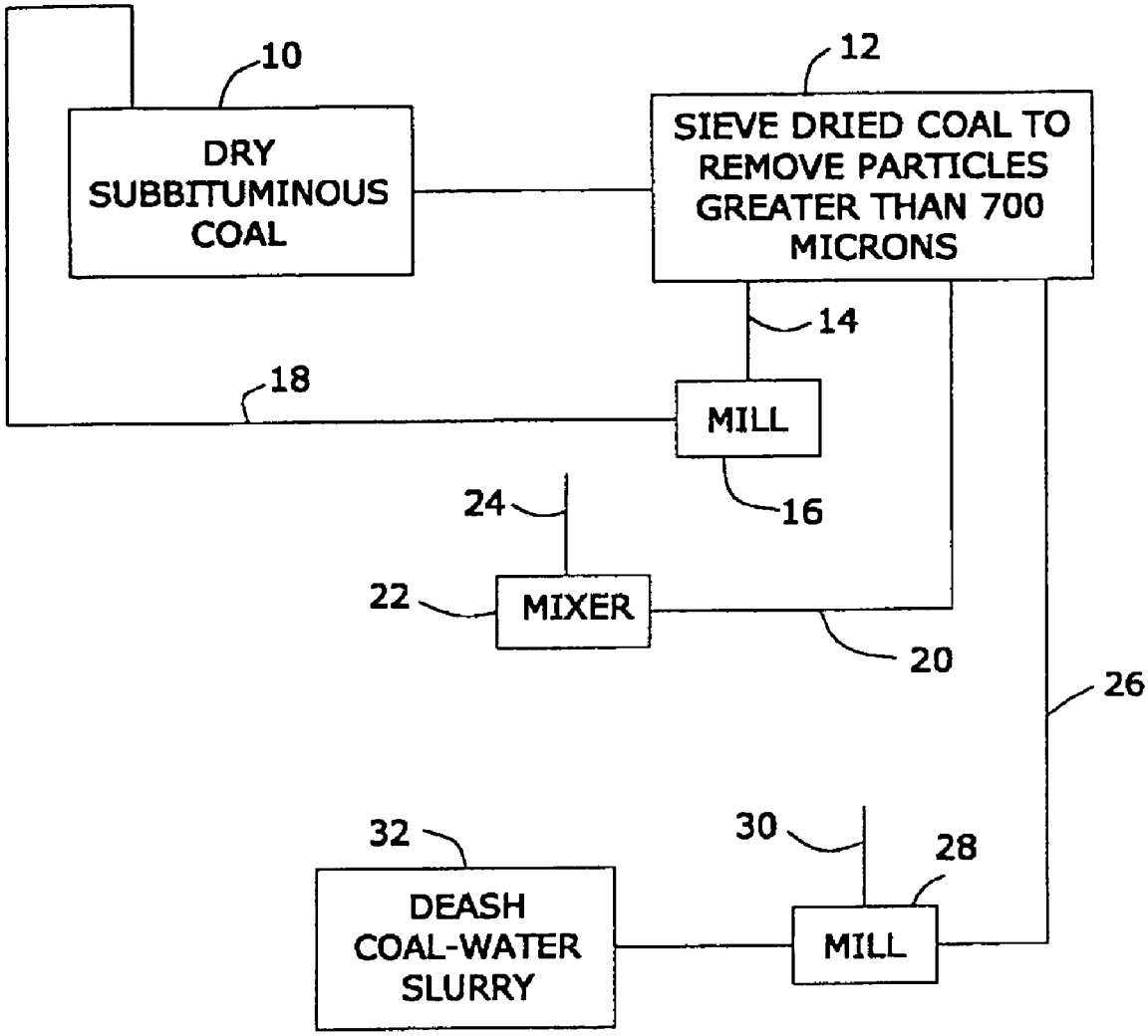
FIG. 1 is a schematic of one preferred process for preparing a coal-water slurry.

FIG. 1 is a schematic of one preferred process for preparing a coal-water slurry.

As is disclosed in applicant's U.S. Pat. Nos. 5,830,246 and 5,830,247, the entire disclosure of each of which is hereby incorporated by reference into this specification, many coals contain from about 15 to about 40 weight percent of moisture. Thus, and referring to Column 1 of U.S. Pat. No. 5,830,246 (see lines 7 et seq.), "Many coals contain up to about 30 weight percent of moisture. This moisture not only does not add to the fuel value of the coal, but also is relatively expensive to transport."

In one embodiment, the coal used in the process of this specification is similar to the coal used in the process of U.S. Pat. No. 5,830,246. Thus, and referring again to U.S. Pat. No. 5,830,246 (see Column 2), "It is preferred that the coal used in the process of FIG. 1 contain from about 5 to about 30 weight percent of moisture and, more preferably, from about 10 to about 30 weight percent of moisture." However, in the instant case, the coal used may often contain up to about 40 weight percent of water.

As is also disclosed in column 2 of U.S. Pat. No. 5,830,246, " . . . the moisture content of coal may be determined by conventional means in accordance with standard A.S.T.M. testing procedures. Means for determining the moisture content of coal are well known in the art; see, e.g., U.S. Pat. No. 5,527,365 (irreversible drying of carbonaceous fuels), U.S. Pat. Nos. 5,503,646, 5,411,560 (production of binderless pellets from low rank coal), U.S. Pat. Nos. 5,396,260, 5,361,513 (apparatus for drying and briquetting coal), U.S. Pat. No. 5,327,717, and the like. The entire disclosure of each of these United States patents is hereby incorporated by reference into this specification."

In one preferred embodiment, the coal used in the process of this invention contains from about 10 to about 25 percent of combined oxygen. The combined oxygen content of certain coals, and means for determining them, are described in column 2 of U.S. Pat. No. 5,830,246, wherein it is disclosed that "It is also preferred that the coal used in the process of FIG. 1 contain from about 10 to about 20 weight of combined oxygen, in the form, e.g., of carboxyl groups, carbonyl groups, and hydroxyl groups. As used in this specification, the term "combined oxygen" means oxygen which is chemically bound to carbon atoms in the coal. See, e.g., H. H. Lowry, editor, "Chemistry of Coal Utilization" (John Wiley and Sons, Inc., New York, N.Y., 1963) . . . . The combined oxygen content of such coal may be determined, e.g., by standard analytical techniques; see, e.g., U.S. Pat. Nos. 5,444,733, 5,171,474, 5,050,310, 4,852,384 (combined oxygen analyzer), U.S. Pat. No. 3,424,573, and the like. The disclosure of each of these United States patents is hereby incorporated by reference into this specification."

In one embodiment, the coal used in the process of the instant invention contains from about 10 to about 25 weight percent of ash. Ash-containing coals are also described in column 2 of U.S. Pat. No. 5,830,246, wherein it is disclosed that "In one embodiment, the coal charged to feeder 12 contains at least about 10 weight percent of ash. As used herein, the term ash refers to the inorganic residue left after the ignition of combustible substances; see, e.g., U.S. Pat. No. 5,534,137 (high ash coal), U.S. Pat. No. 5,521,132 (raw coal fly ash), U.S. Pat. No. 4,795,037 (high ash coal), U.S. Pat. No. 4,575,418 (removal of ash from coal), U.S. Pat. No. 4,486,894 (method and apparatus for sensing the ash content of coal), and the like. The disclosure of each of these United States patents is hereby incorporated by reference into this specification. By way of further illustration, one suitable ash containing coal which may be used in this embodiment is Herrin number 6 coal, from Illinois."

The coal produced by the process of U.S. Pat. No. 5,830,246, when subbituminous coal is used as the starting material, has a particle distribution that renders it unsuitable for making a stable slurry. When this coal is mixed with from about 25 to about 35 weight percent of water (by total weight of water and coal), the slurry thus produced is unstable.

FIG. 1 is a flow diagram of a stable coal-water slurry made from subbituminous coal, wherein said slurry has a solids content of at least 65 weight percent and a heating value that is at least about 80 percent of the heating value of the undried coal.

Referring to FIG. 1, and to the preferred embodiment depicted therein, in step 10 subbituminous coal is dried to a moisture content of less than about 5 percent.

In one embodiment, the process of the instant specification is used to dry such coal. This process will be described elsewhere in this specification, by reference to FIGS. 2, 3, and 4.

In one embodiment, the process of U.S. Pat. No. 5,830,246 is utilized to dry such coal; the entire disclosure of such patent is hereby incorporated by reference into this specification. This patent describes and claims: "A process for preparing an irreversibly dried coal, comprising the steps of: (a) providing a fluidized bed reactor with a fluidized density of from about 10 to about 40 pounds per cubic foot; (b) maintaining said fluidized bed reactor at a temperature of from about 225 to about 500 degrees Fahrenheit; (c) feeding to said fluidized bed reactor coal with a moisture content of from about 5 to about 30 percent and a combined oxygen content of from about 10 to about 20 percent; (d) feeding to said reactor from about 0.5 to about 3.0 weight percent (by weight of dried coal) of mineral oil with an initial boiling point of at least about 900 degrees Fahrenheit, thereby producing a coated coal; and (e) subjecting said coated coal to said temperature of from about 225 to about 500 degrees Fahrenheit in said reactor for from about 1 to about 5 minutes while simultaneously comminuting and dewatering said coated coal, whereby a comminuted coal is produced wherein: (1.) after said coated coal is exposed to an ambient environment at a temperature of 25 degrees Centigrade and a relative humidity of 50 percent, it contains less than 2.0 percent of moisture, by weight of coal, (2.) at least about 80 weight percent of the particles of said coated coal are smaller than 74 microns, and (3.) said coal has a combined oxygen content of from about 10 to about 20 weight percent."

In another embodiment, the process of U.S. Pat. No. 5,830,247 is used in order to prepare the dried subbituminous coal. This patent describes and claims: "A process for preparing an irreversibly dried coal, comprising the steps of: (a) providing a first fluidized bed reactor with a fluidized bed density of from about 20 to about 40 pounds per cubic foot, wherein said reactor is maintained at a temperature of from about 150 to about 200 degrees Fahrenheit, (b) feeding to said reactor coal with a moisture content of from about 15 to about 30 percent, an oxygen content of from about 10 to about 20 percent, and a particle size such that all of the coal particles in such coal are in the range of from 0 to 2 inches, (c) subjecting said coal in said first fluidized bed reactor to said temperature of from about 150 to about 200 degrees Fahrenheit for from about 1 to about 5 minutes while simultaneously comminuting and dewatering said coal, (d) passing said comminuted and dewatered coal to a second fluidized bed reactor with a fluidized bed density of from about 20 to about 40 pounds per cubic feet, wherein said reactor is at a temperature of from about 480 to about 600 degrees Fahrenheit, (e) feeding to said second fluidized bed reactor from about 0.5 to about 3.0 weight percent (by weight of dried coal) of mineral oil with an initial boiling point of at least about 900 degrees Fahrenheit, thereby producing a coated coal, (f) subjecting said coated coal to said temperature of from about 480 to about 600 degrees Fahrenheit for from about 1 to about 5 minutes while simultaneously comminuting and dewatering said coated coal, whereby a comminuted and dehydrated coal is produced."

Applicant has discovered that, because of his use of a particular subbituminous coal with specified properties, the drying step 10 is critical in order for him to obtain a stable slurry. It should be noted that other coals often do not require such a drying step in order to produce a stable slurry.

Thus, by way of illustration and not limitation, in U.S. Pat. No. 4,282,006 (the entire disclosure of which is hereby incorporated by reference into this specification), the preparation of a 75 weight percent coal-water slurry using coal from the Black Mesa mine is described (see Example 3). The properties and chemical composition of such coal is not described in U.S. Pat. No. 4,282,006.

Without wishing to be bound to any particular theory, applicant believes that the "Black Mesa" coal described in U.S. Pat. No. 4,282,006 did not have a combined oxygen content of from about 10 to about 25 percent. If it had, applicant believes, one would not have been able to make a stable slurry from it by drying.

Applicant has discovered that, when coal with an oxygen content of from about 10 to about 25 percent is mixed with a sufficient amount of water to produce a slurry with a solids content of from about 65 to about 75 weight percent, such slurry is often not stable. When such coal is first dried and then modified in accordance with steps 12 et seq. may a stable slurry may often be made from such coal."

Referring again to FIG. 1, and in the preferred embodiment depicted therein, after the dried coal has been produced in step 10, it is subject to a sieving operation in step 12 to remove oversize particles. It is preferred, in such an operation, to remove all of the particles greater than about 700 microns. In one embodiment, all particles greater than about 500 microns are removed.

The oversize particles are then fed via line to mill 16, wherein they are ground and then recycled via line 18 to the dry subbituminous coal supply 10.

The undersize particles may be fed via line 20 to mixer 22. In mixer 22, a sufficient amount of water is added via line 24 to produce a coal/water mixture with a solids content (by weight of dry coal) of from about 65 to about 75 weight percent. Additionally, one may add dispersing agent and/or electrolyte in accordance with the process described in U.S. Pat. No. 4,282,006, the entire disclosure of which is hereby incorporated by reference into this specification.

Referring again to FIG. 1, and in the preferred embodiment depicted therein, in one aspect of this embodiment the sieved, dried coal is fed via line 26 to mill 28 (which may be, e.g., a ball mill) in which the coal is preferably ground to the particle size distribution described in U.S. Pat. No. 4,282,006. In particular, the coal is ground until at least about 5 weight percent of its particles are of colloidal size, and until a coal compact is produced that is described by the "CPFT" formula set forth in claim 1 of U.S. Pat. No. 4,282,006.

Referring again to FIG. 1, one may add one or more other coal compacts to the mill 28 via line 30, and/or one may add water and/or surfactant and/or electrolyte.

In one embodiment, and referring again to FIG. 1, the coal-water slurry produced in mill 28 is deashed in step 32. In one embodiment, the deashing process described in U.S. Pat. No. 4,468,232 is used; the entire disclosure of such United States patent is hereby incorporated by reference into this specification.

U.S. Pat. No. 4,468,232 describes and claims: "A process for preparing a clean coal-water slurry, comprising the steps of: (a) providing a coal-water mixture comprised of from about 60 to about 80 volume percent of solids; (b) grinding said coal-water mixture until a coal-water slurry is produced wherein: 1. said slurry has a yield stress of from about 3 to about 18 Pascals and a Brookfield viscosity at a solids content of 70 volume percent, ambient temperature, ambient pressure, and a shear rate of 100 revolutions per minute, of less than 5,000 centipoise; 2. said slurry is comprised of a consist of finely divided particles of coal dispersed in water, and said consist has a specific surface area of from about 0.8 to about 4.0 square meters per cubic centimeter and an interstitial porosity of less than about 20 volume percent; 3. from about 5 to about 70 weight percent of said finely divided particles of coal in said water are of colloidal size, being smaller than about 3.0 microns; 4. said consist of finely divided particles of coal has a particle size distribution substantially in accordance with the following formula:

$$\frac{CPFT}{100} = \sum_{j=1}^{k}\left[X_j\left(\frac{D^{Nj} - D_{sj}^{Nj}}{D_{Lj}^{Nj} - D_{sj}^{Nj}}\right)\right]$$

$$\text{where } \sum_{j=1}^{k} X_j = 1.0$$

$$\text{and where if } D < D_{sj}\left(\frac{D^{Nj} - D_{sj}^{Nj}}{D_{Lj}^{Nj} - D_{sj}^{Nj}}\right) = 0.0$$

$$\text{and where if } D > D_{Lj}\left(\frac{D^{Nj} - D_{sj}^{Nj}}{D_{Lj}^{Nj} - D_{sj}^{Nj}}\right) = 1.0$$

wherein: (a) CPFT is the cumulative percent of said solid carbonaceous material finer than a certain specified particle size D, in volume percent; (b) k is the number of component distributions in the compact and is at least 1; (c) Xj is the fractional amount of the component j in the compact, is less than or equal to 1.0, and the sum of all of the Xj's in the consist is 1.0; (d) N is the distribution modulus of fraction j and is greater than about 0.001; (e) D is the diameter of any particle in the compact and ranges from about 0.05 to about 1180 microns; (f) Ds is the diameter of the smaller particle in fraction j, as measured at 1% CPFT on a plot of CPFT versus size D, is less than DL, and is greater than 0.05 microns; and (g) DL is the diameter of the size modulus in fraction j, measured by sieve size or its equivalent, and is from about 15 to about 1180 microns; 5. at least about 85 weight percent of the coal particles in the consist have a particle size less than about 300 microns; and 6. the net zeta potential of said colloidal sized particles of coal is from about 15 to about 85 millivolts; and (c) cleaning said coal."

A Multistage Process for Drying Coal

Figure 2:
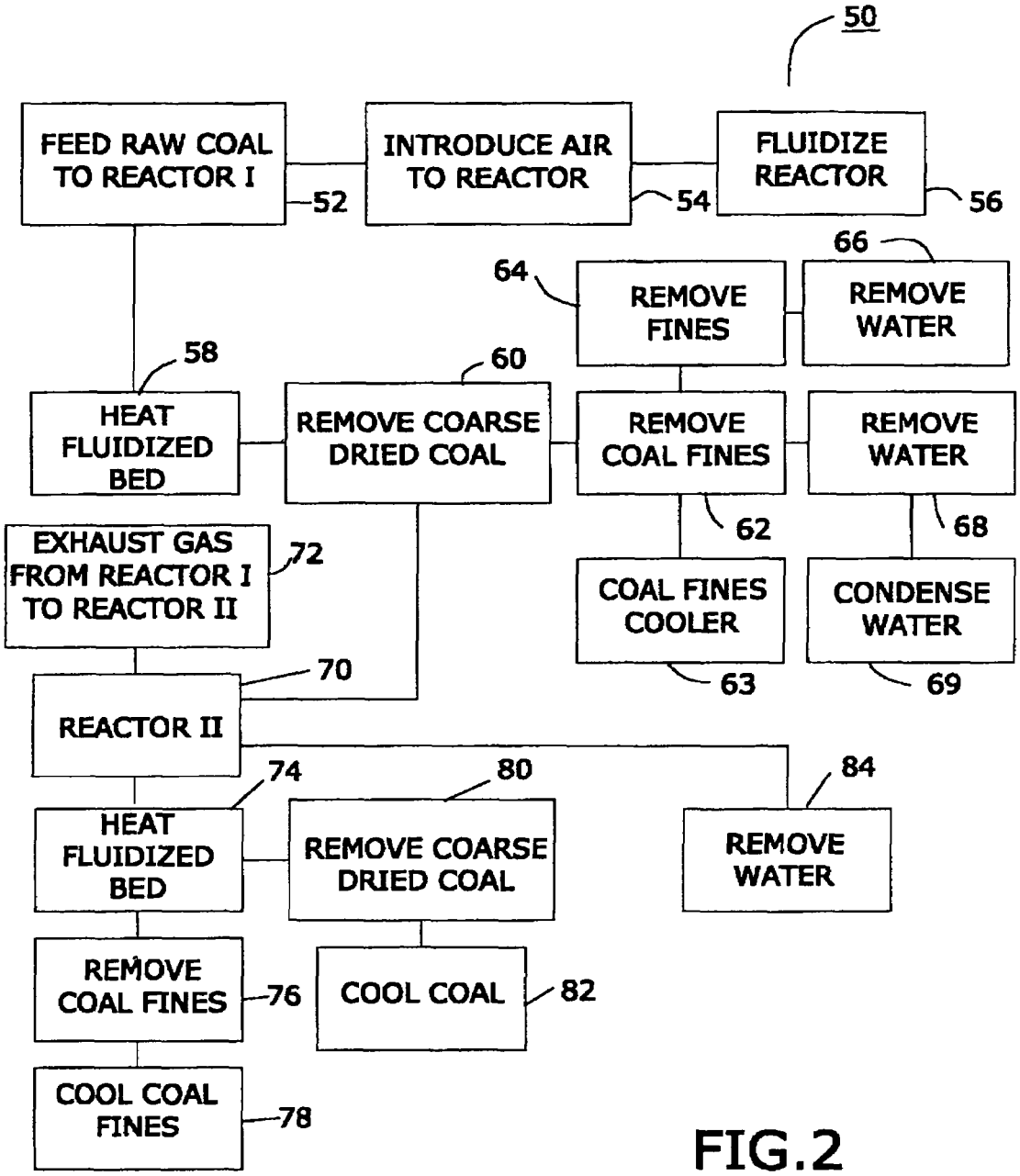
FIG. 2 is a schematic of one preferred process for drying the coal used in the process of FIG. 1.

FIG. 2 is a flow diagram of one preferred process 50 for drying coal. In step 52 of the process, raw coal is fed to reactor 1.

The coal used in process 50 is similar to the coal described in column 1 (see lines 16-61 of column 3) of U.S. Pat. No. 6,162,265, with the exception that it preferably contains from about 15 to about 40 weight percent of moisture, may contain from about 10 to about 25 weight percent of combined oxygen, and may contain from about 10 to about 25 weight percent of ash.

The coal used in process 50 may be lignitic or sub-bituminous coal. Thus, and as is disclosed at lines 62 et seq. of column 3 of U.S. Pat. No. 6,162,265, " . . . the coal which is added to feeder assembly 12 may be, e.g., lignite, sub-bituminous, and bituminous coals. These coals are described in applicant's U.S. Pat. No. 5,145,489, the entire disclosure of which is hereby incorporated by reference into this specification."

In one preferred embodiment, the coal used in step 52 is 2"×0", and more preferably 2" by ¼" or smaller. As is known to those skilled in the art, 2" by ¼" coal has all of its particles within the range of from about 0.25 to about 2.0 inches.

Crushed coal conventionally has the 2"×0" particle size distribution. This crushed coal can advantageously be used in applicant's process.

Figure 3:
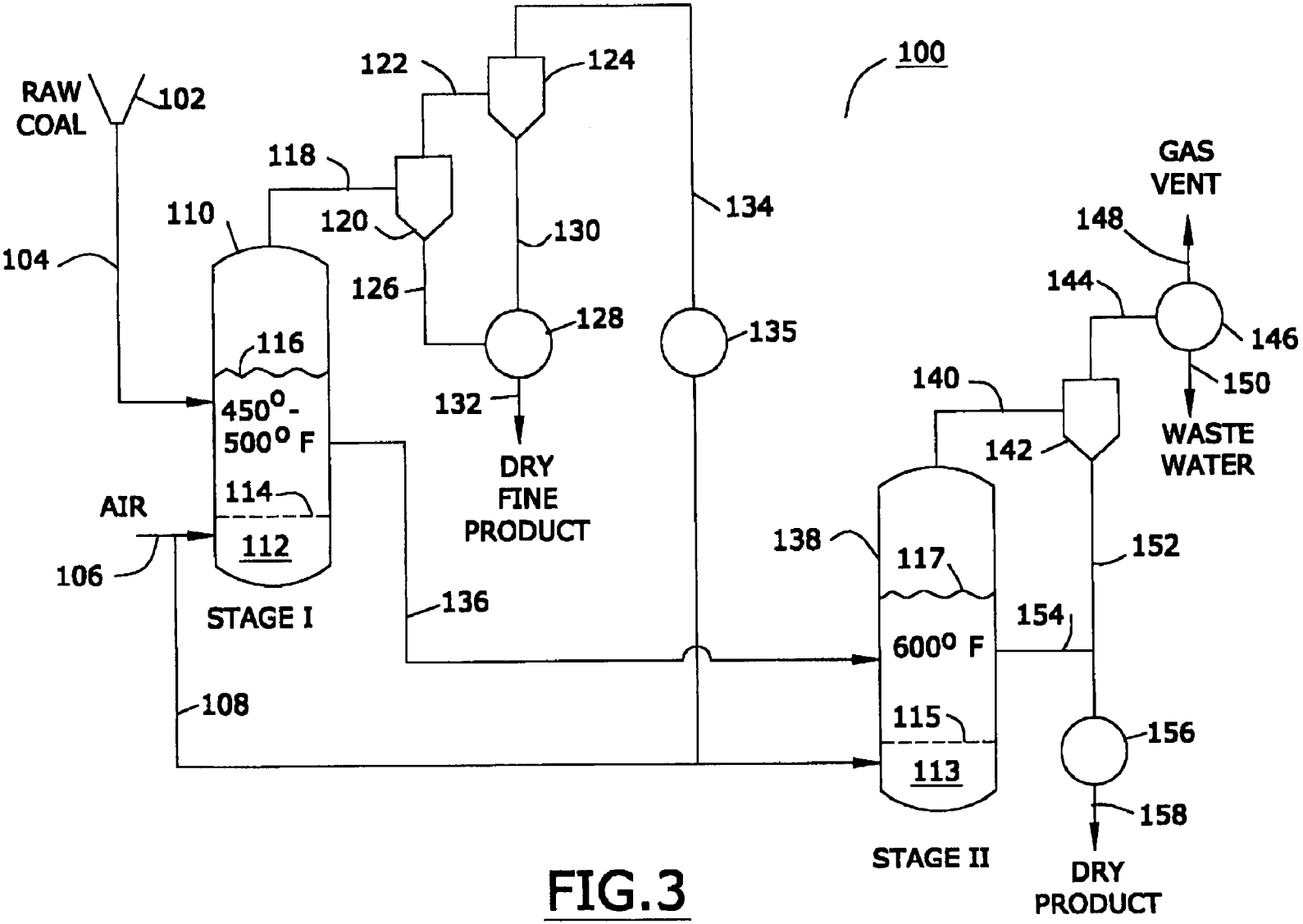
FIG. 3 is a schematic of one preferred apparatus that may be used in the process of FIG. 2.
Figure 4:
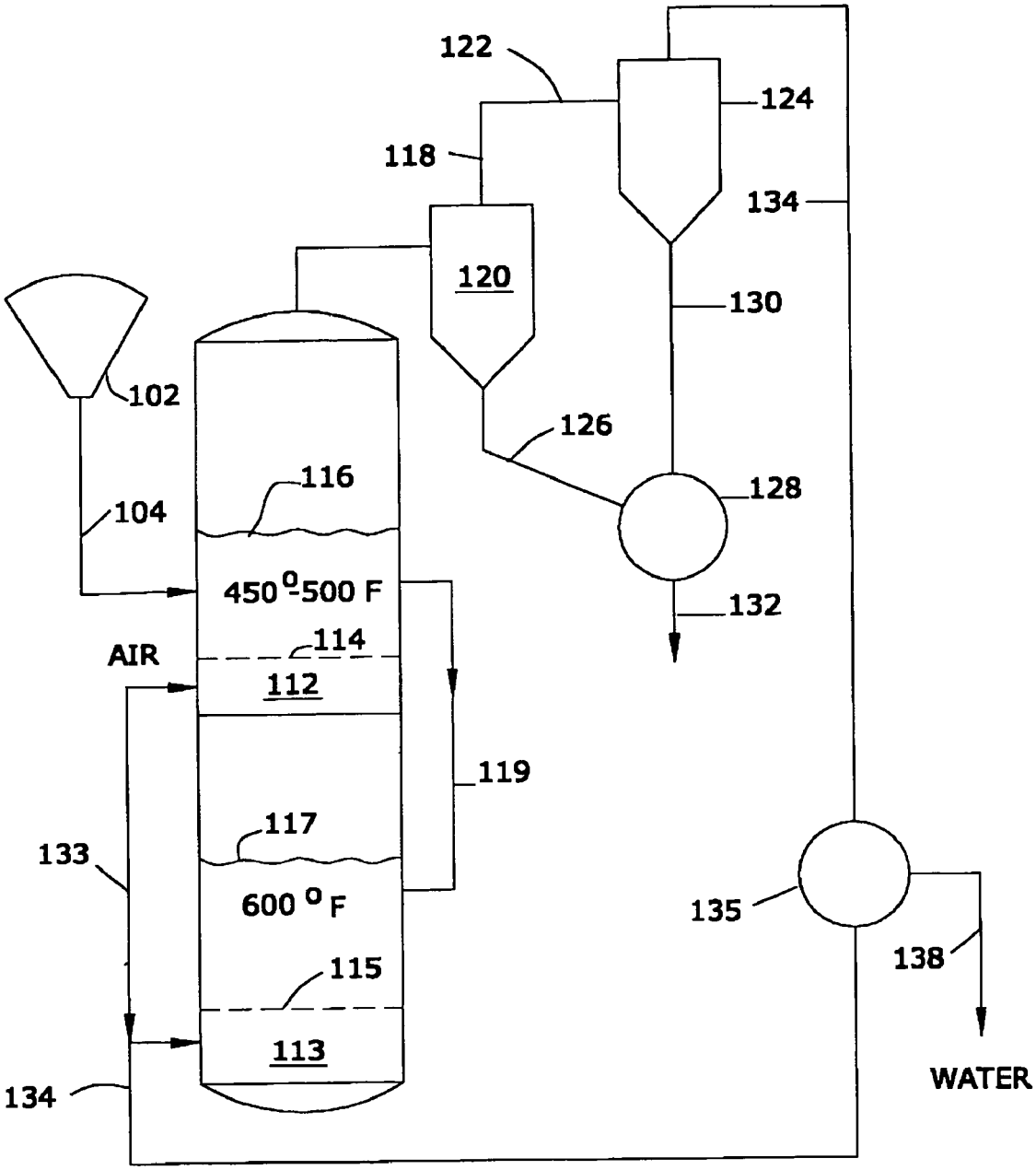
FIG. 4 is a schematic of another preferred apparatus that may be used in the process of FIG. 2.

Referring again to FIG. 2, and in the preferred embodiment illustrated therein, in step 52 the raw coal is preferably fed from a feeder 102 (see FIG. 3; also see FIG. 4). This feeder 102 may be similar to, or identical to the feeder 12 described in column 4 of U.S. Pat. No. 6,162,265, the entire disclosure of which is hereby incorporated by reference into this specification.

Referring to such column 4 of U.S. Pat. No. 6,162,265, it is disclosed that

" . . . the coal is fed into feeder 12. Feeder 12 can be any coal feeder commonly used in the art. Thus, e.g., one may use one or more of the coal feeders described in U.S. Pat. Nos. 5,265,774, 5,030,054 (mechanical/pneumatic coal feeder), U.S. Pat. No. 4,497,122 (rotary coal feeder), U.S. Pat. Nos. 4,430,963, 4,353,427 (gravimetric coal feeder), U.S. Pat. Nos. 4,341,530, 4,142,868 (rotary piston coal feeder), U.S. Pat. No. 4,140,228 (dry piston coal feeder), U.S. Pat. No. 4,071,151 (vibratory high pressure coal feeder with helical ramp), U.S. Pat. No. 4,149,228, and the like. The disclosure of each of these United States patents is hereby incorporated by reference into this specification.

Referring again to FIG. 1, feeder 12 is comprised of a hopper (not shown) and a star feeder (not shown). It is preferred that feeder 12 be capable of continually delivering coal to fluidized bed 10."

U.S. Pat. No. 6,162,265 also discloses that "In one embodiment, not illustrated, a star feeder is used. A star feeder is a metering device which may be operated by a controller which controls the rate of coal removal from a hopper; see, e.g., U.S. Pat. No. 5,568,896, the entire disclosure of which is hereby incorporated by reference into this specification."

Referring again to FIG. 2, and in step 54 thereof, air is introduced into a first fluidized bed reactor. Referring to FIG. 3, and in the preferred embodiment depicted therein, air is introduced into reactor 110 via line 106.

The air may be introduced by conventional means such as, e.g., a blower (not shown). In one embodiment, the air so introduced preferably is hot air at a temperature of from about 250 to about 400 degrees Fahrenheit, and preferably from about 300 to about 350 degrees Fahrenheit.

The air is introduced via line 106 into a fluidized bed 112 in order to preferably maintain the temperature of such fluidized bed 112 at a temperature of from about 300 to about 550 degrees Fahrenheit and, more preferably, from about 450 to about 500 degrees Fahrenheit. Without wishing to be bound to any particular theory, applicant believes that this hot air helps oxidize a portion of the coal in the first reactor 110, thereby supplying energy required to vaporize the water in such coal.

In one preferred embodiment, the air is introduced and injected via line 106 into fluidized bed 112 at a fluidizing velocity in the reactor vessel of greater than about 4 feet per second, and, more preferably, greater than about 5 feet per second. In one aspect of this embodiment, the air is introduced via line 106 at a fluidizing velocity of from about 5 to about 8 feet per second. In another aspect of this embodiment, the air is introduced via line 6 at a fluidizing velocity of from about 6 to about 8 feet per second. Without wishing to be bound to any particular theory, applicant believes that maintaining the air flow within the desired ranges is essential for maintaining the desired conditions within the fluidized bed 112 and for conducting an efficient drying operation.

Referring again to FIG. 2, in step 56 of the process the reactor 110 is fluidized, i.e., a fluidized bed is established therein. One may establish such a fluidized bed by conventional means such as, e.g., the means disclosed in U.S. Pat. No. 6,162,265, at column 4 thereof. Referring to such column 4, it is disclosed that " . . . a fluidized bed 14 is provided in a reactor vessel 10. The fluidized bed 14 is comprised of a bed of fluidized coal particles, and it preferably has a density of from about 20 to about 40 pounds per cubic foot. In one embodiment, the density of the fluidized bed 20 is from about 20 to about 30 pounds per cubic foot. The fluidized bed density is the density of the bed while its materials are in the fluid state and does not refer to the particulate density of the materials in the bed . . . . Fluidized bed 14 may be provided by any of the means well known to those skilled in the art. Reference may be had, e.g., to applicant's U.S. Pat. Nos. 5,145,489, 5,547,549, 5,546,875 (heat treatment of coal in a fluidized bed reactor), U.S. Pat. No. 5,197,398 (separation of pyrite from coal in a fluidized bed), U.S. Pat. No. 5,087,269 (drying fine coal in a fluidized bed), U.S. Pat. No. 4,571,174 (drying particulate low rank coal in a fluidized bed), U.S. Pat. No. 4,495,710 (stabilizing particulate low rank coal in a fluidized bed), U.S. Pat. No. 4,324,544 (drying coal by partial combustion in a fluidized bed), and the like." In the process of this instant invention, air is fed into the fluidized bed to heat the fluidized bed and to maintain the bed at the desired density.

Without wishing to be bound to any particular theory, applicant believes that, in order to efficiently maintain the fluidized bed 112 at the desired density, the air flow into the fluidized bed should preferably be from about 5 to about 8 feet per second. Air flow outside of these ranges does not yield the desired results.

The reactors 110 and 138 are often cylindrical reactors that, a larger sizes, and when used with one-stage processes, often require gas velocities of about 18 feet per second or more. Without wishing to be bound to any particular theory, applicant believes that velocities of this magnitude often result in excessive entrainment of the fluidized bed and/or may distort the fluidization in the fluidized bed. In any event, velocities of this magnitude do not produce the drying results obtained with applicant's invention.

Referring again to FIG. 2, and in step 58 thereof, the fluidized bed 112 (see FIG. 3) is heated. One may heat the fluidized bed 112 by conventional means such as, e.g., using hot air provided in another reactor (not shown) and/or another device. Thus, e.g., one may provide the hot air to line 106 from a separate fluidized bed reactor. This option is discussed at lines 64 et seq. of column 4 of U.S. Pat. No. 6,162,265, wherein it is disclosed that "Fluidized bed 14 is preferably maintained at a temperature of from about 150 to about 200 degrees Fahrenheit. In a more preferred embodiment, the fluidized bed 14 is maintained at a temperature of from about 165 to about 185 degrees Fahrenheit. Various means may be used to maintain the temperature of fluidized bed 14 at a temperature of from about 150 to about 200 degrees Fahrenheit. Thus, e.g., one may use an internal or external heat exchanger (not shown). See, e.g., U.S. Pat. Nos. 5,537,941, 5,471,955, 5,442,919, 5,477,850, 5,462,932, and the like . . . . In one embodiment, illustrated in FIG. 1, hot gas from, e.g., a separate fluidized bed reactor 18 is fed via line 20 into fluidized bed 14. This hot gas preferably is at temperature of from about 480 to about 600 degrees Fahrenheit and, more preferably, at a temperature of from about 525 to about 575 degrees Fahrenheit."

In another embodiment, not shown, the air fed via line 6 is hot air provided by a heat exchanger, not shown. Thus, e.g., one may use an internal or external heat exchanger (not shown). See, e.g., U.S. Pat. Nos. 5,537,941, 5,471,955, 5,442,919, 5,477,850, 5,462,932, and the like; the entire disclosure of each of these United States patents is hereby incorporated by reference into this specification.

Referring again to FIG. 3, and in the preferred embodiment depicted therein, it will be seen that a portion of the air fed via line 106 is diverted via line 108 into reactor 138, thereby effecting step 74 (the heating of the fluidized bed 113 in reactor 138). The air fed into reactor 113 is preferably fed at a velocity of from about 8 to about 12.2 feet per second. Without wishing to be bound to any particular theory, applicant believes that this rate of air flow in reactor 138 is essential to maintain the fluidized bed under the desired conditions and to obtain the desired efficiency of drying; the use of lower or higher air flow velocities is undesirable and ineffective.

Referring again to FIG. 2, in step 62 of the process, coal "fines" are removed from the reaction mass disposed within the fluidized bed 112. The finer coal portions (i.e., those with a particle size less than about 400 microns) are entrained from the top 116 of the fluidized bed to the cyclone 120 via line 118. The coarser component of the entrained stream will preferably be cooled in cooler 128, as are the coarser components from cyclone 124. In the embodiment illustrated in FIG. 3, the finer fraction from cyclone 120 is preferably passed via line 122 to cyclone 124. The coarser component from cyclone 124 is then fed to cooler 128; and the fraction so cooled is then passed to storage 132. The exhaust gas fed via line 134 is blended with the air in line 108, and the blended hot gases are then fed into the reactor 138.

One may use any of the cyclones known to the prior art; thus, e.g., one may use the cyclones disclosed in U.S. Pat. No. 6,162,265 (see, e.g., column 7 thereof). As is disclosed in such patent, one may use any of the cyclones conventionally used in fluid bed reactors useful for separating solids from gas. Thus, e.g., one may use as cyclone 54 the cyclones described in U.S. Pat. No. 5,612,003 (fluidized bed with cyclone), U.S. Pat. No. 5,174,799 (cyclone separator for a fluidized bed reactor), U.S. Pat. Nos. 5,625,119, 5,562,884, and the like. The entire disclosure of each of these United States patents is hereby incorporated by reference into this specification.

Referring again to FIG. 3, in reactor 110 water is removed from the coal fed via line 104. This step is also indicated, as step 68, in FIG. 2.

The raw coal fed via line 104 preferably contains from about 15 to about 40 weight percent of water. By comparison, the coal withdrawn via line 136 (see FIG. 3) contains from about 40 to about 60 percent less water. Put another way, the ratio of the water concentration in the raw coal divided by the water concentration in the dry coal is at from about 1.6 to about 2.5.

Referring again to FIG. 3, the water removed from the coal within the reactor 110 is passed together with flue gas and fines via line 118 to cyclone 120 and thence, via line 122 to cyclone 124. Thereafter, it passes via line 134 to condenser 135, wherein it is removed. The gas passing from condenser is preferably substantially dry, containing less than about 5 weight percent of water. Thereafter, this dry gas is mixed with the air in line 108 and thence fed into the fluidized bed 113 as its fluidizing medium.

Referring again to FIG. 3, the raw coal from feeder 102 is maintained in reactor 110 for a time sufficient to remove from about 40 to about 60 weight percent of the water in the raw coal. Generally, such "residence time" is preferably less than about 15 minutes and frequently is from about 5 to about 12 minutes. In a preferred embodiment, the residence time is from about 5 to about 7 minutes.

Referring again to FIG. 2, and in step 60 thereof, the dried coal from reactor 110 is removed from such reactor and fed into reactor 138 via line 136. Simultaneously, or sequentially, in step 72 exhaust gas is fed (via line 108, see FIG. 3) from line 106, it is preferably mixed with dry gas from condenser 135, and it is then fed into fluidized bed 113.

In step 74 of the process, the fluidized bed 113 is heated to a temperature that preferably is at least 50 degrees Fahrenheit higher than the temperature at which fluidized bed 112 is maintained at. The temperature in fluidized bed 113 preferably is from about 450 to about 650 degrees Fahrenheit and, more preferably, from about 550 to about 600 degrees Fahrenheit.

The fluidized bed 113 is preferably heated by both the hot coal fed via line 136, and/or the heat in the gas fed via line 108, and/or the combustion processes involved in said fluidized bed (often referred to as "off gas"). In a manner similar to that depicted for reactor 110, water is removed from the coal in fluidized bed 113, and such coal is then discharged via line 154; in general, the water content of such coal is preferably less than about 1 weight percent.

The water removed from the coal in reactor 138 is fed via line 140 (together with "fines" and as) to cyclone 142 and thence via line 144 to a condenser 146; the waste water from condenser 146 is then removed via line 150. This step is depicted as step 84 in FIG. 2.

In step 76, the fines are removed from the reactor 138 via line 140. The solid product from cyclone 142 is then fed via line 152 and preferably blended with the dry coal from line 154. The blend is then fed to cooler 156, wherein it is preferably cooled to ambient temperature; and then is fed via line 158 to storage.

FIG. 4 is a schematic of a preferred apparatus which is similar to the apparatus depicted in FIG. 2 but utilizes a single, compartmentalized vessel instead of the two reactor vessels 110 and 138.

A Process for in-situ Passivation of Partially Dried Coal

Lignitic, bituminous, brown and subbituminous coals are received from the mine containing from about 15 to about 60 weight percent water and such coals are usually subjected to a drying procedure before shipment and use. Such processes often involve drying in an inert environment via pyrolysis. The combustion gases used in the drying process are usually obtained from coal or fuel oil and the fuel air ratio is maintained so that the combustion gases contain from about one to about five percent by volume of oxygen. The dried coal emerging from the dryer generally contains from about 0.5 to about 10% water by weight, and might even be somewhat higher. In some cases, there may be as much as 20% or 30%. Whereas partially dried coal material dried in an inert environment is often unstable, pyrolytic and subject to spontaneous combustion, it is particular suited to treatment by the in-situ passivation process of this invention. As used in this specification, passivated coal is not subject to spontaneous combustion, and passivation is a process rendering coal material not subject to spontaneous combustion. As used in this specification, inert environment shall mean an environment with less than about 5 percent oxygen gas.

The coal drying process of the invention can readily be carried out in an apparatus comprising a moving bed such as a fluidized bed of coal to which the partially dried coal material is fed under the conditions described elsewhere in this specification. For example, a fluidized bed reactor is operated with fluidizing gas made by blending air and recycled off-gas to maintain an oxygen level of about 6% to about 15% by volume and regulating the temperature of the bed at 450° F.-650° F. by introduction of partially dried coal. Preferably, the process takes place at a temperature from about 500 degrees Fahrenheit to about 550 degrees Fahrenheit. The pressure may be atmospheric pressure to about 1000 psig. In this manner, the product coal has been partially oxidized and is extremely stable to spontaneous combustion. After the initial start-up, this process can be operated so that little or no external source of heat is required, advantageously using in-situ generated thermal energy.

In one embodiment, the fluidized bed reactor has a height of ten feet and a diameter of three feet. It is to be understood that any size fluid bed reactor may be used with this process.

Figure 5:
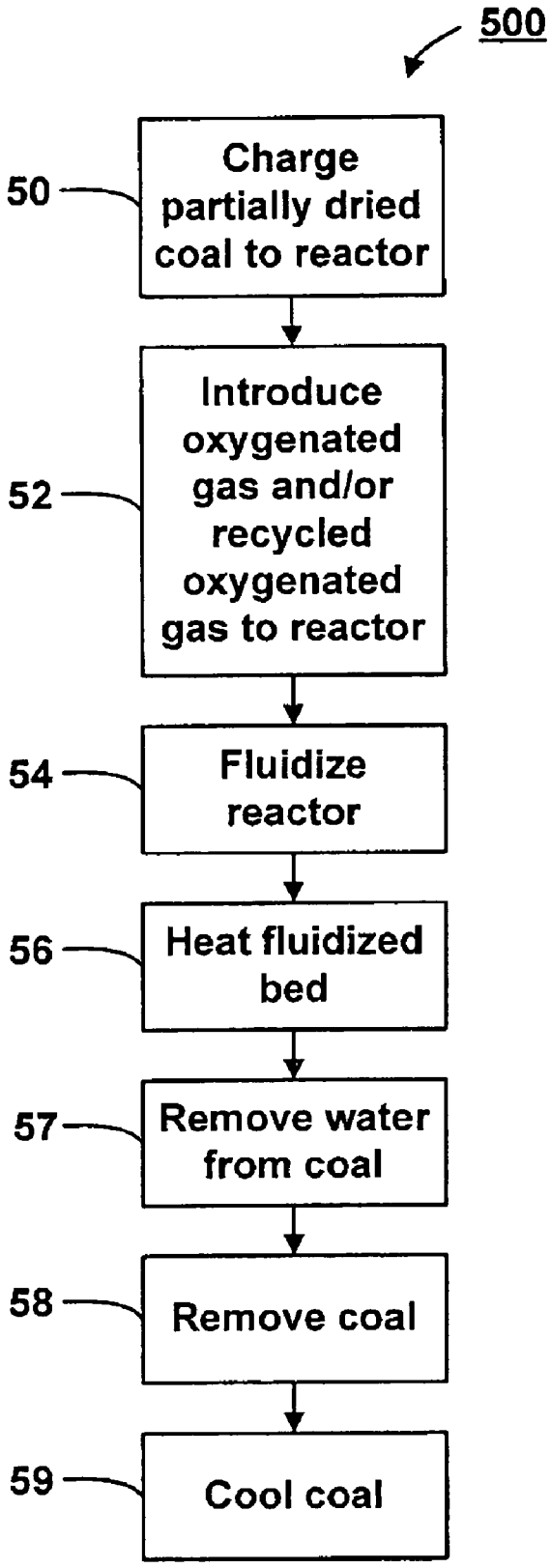
FIG. 5 is a flow diagram of one preferred process for passivating coal.
Figure 6:
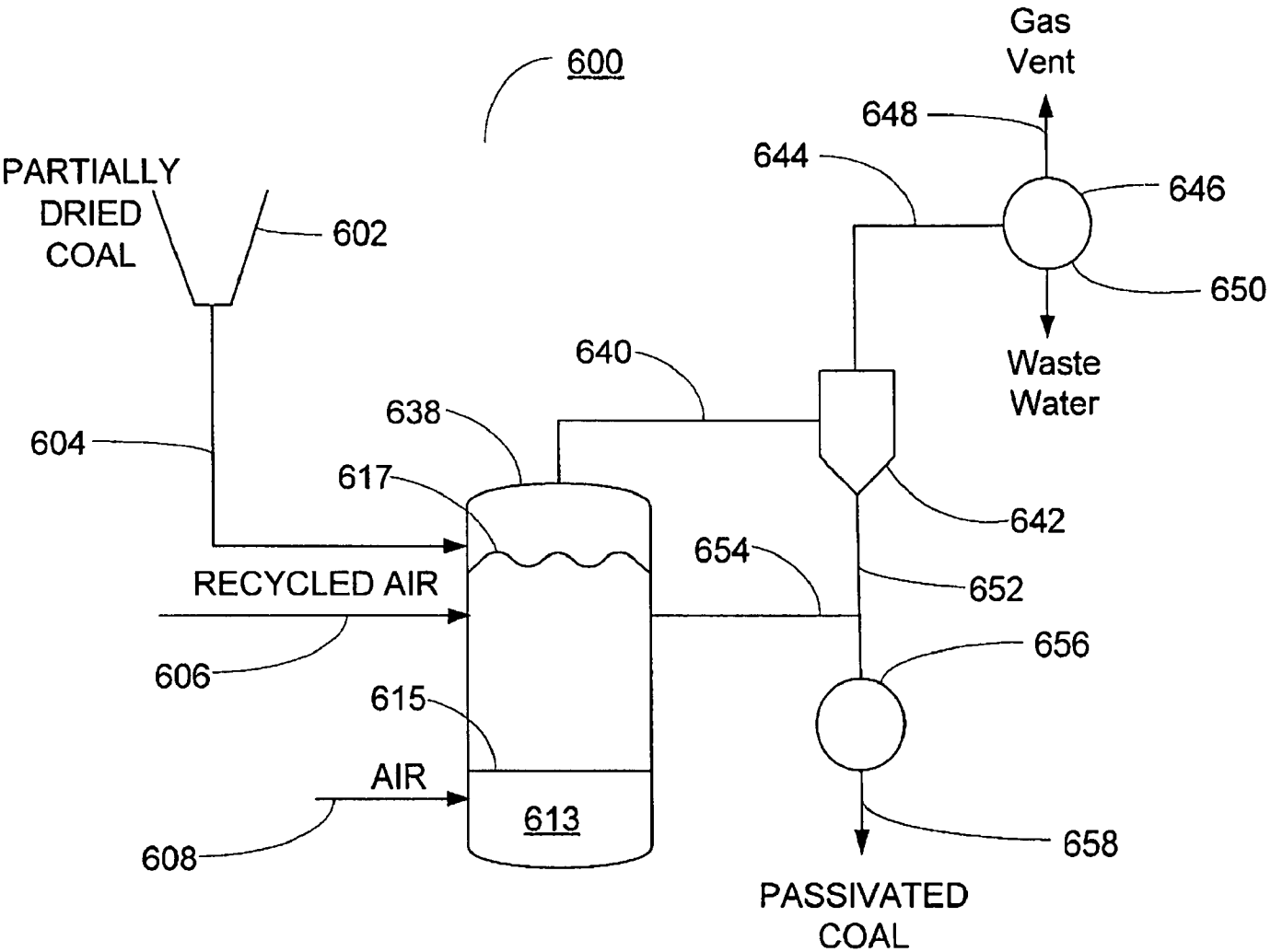
FIG. 6 is a schematic of one preferred apparatus that may used is the process of FIG. 5.

FIG. 5 is a flow diagram of one preferred process 500 for simultaneously drying and passivating partially-dried low-rank coal. FIG. 6 depicts an apparatus 600 that may be used in process 500. Referring again to FIG. 5, in step 50 of process 500, the partially dried coal material is conveyed into a moving bed of hot coal at a temperature in the range from about 450° F. to about 650° F. at a rate sufficient to maintain partial combustion of the coal at atmospheric pressure. In one embodiment depicted in FIG. 6, step 50 involves charging, e.g. feeding, pyrophoric partially dried coal from a hopper 602 into the bottom of a fluidized bed reactor 613 via a screw feeder 604 at a rate of from about one to about four thousand pounds per hour. It is to be understood that the rate may vary and be optimized according to the fluid bed reactor size and type used in carrying out the process of this invention. In one embodiment, it is desirable that the partially dried coal be fed to the reaction vessel at a rate of three thousand pounds per hour. In another embodiment, it is desirable that the partially dried coal be fed to the reaction vessel at a rate of three hundred pounds per hour.

Referring again to FIGS. 5 and 6, in another embodiment, a star feeder 604, as described elsewhere in this specification, may be used to charge (feed) the coal material to the reactor in step 50 of process 500. Alternatively, any of the commercially available blending apparatus may be employed in the process, including but not limited to, a rotating drum or belt conveyor. Alternatively, in another embodiment, any appropriate feeder known to one skilled in the art may be used to charge the coal into the reaction vessel in step 50 of process 500.

In some respects of this invention, such partially dried coal or char material may have been dried by a pyrolysis process. In some respects of this invention, such partially dried coal or char material may have been dried in an inert environment. In other aspects, such partially dried coal has been dried by a process described elsewhere in this specification.

In some embodiments, the coal used may be lignitic, bituminous or sub-bituminous crushed coal with a particle size of no larger than about 2 inches by one-quarter inch. In another embodiment, 1" by 0" size particles may be used. Preferably, the carbonaceous material may contain from about 0.01 weight percent to about 20 weight percent of moisture, and more preferably may contain from about 1 weight percent to about 15 weight percent of moisture.

This process is particularly advantageous for use with fine coal particulates since they have greater surface area and this more easily oxidize and spontaneously combust. Other coal types and particle sizes described elsewhere in this specification may be used in other embodiments. Optionally, the coal particles are preheated prior to being charged into the reaction vessel. Heating may be accomplished by any conventional means known to those skilled in the art. By way of example, a heat exchanger or propane flame would be suitable in this process. It is desirable that the coal material be heated to a temperature of from about 100 to about 600 degrees Fahrenheit.

Referring again to FIGS. 5 and 6, a fluidized bed reactor as described elsewhere in this specification may be used as the type of reaction vessel. Alternatively, in another embodiment, any appropriate reaction vessel known to one skilled in the art may be used as a reaction vessel.

Referring again to FIGS. 5 and 6, in step 52 of process 500, an oxygenated gas 606, 608 at atmospheric pressure containing from about 6% to about 15% by volume of oxygen is simultaneously passed into the coal burning bed 617 of a fluidized bed reactor 613. In a preferred embodiment, the oxygenated gas 606, 608 is atmospheric air. Heated oxygenated gas 606, 608 is introduced into the lower end of the vessel 615 at sufficient flow rate to fluidize the bed of coal particles 617. The gas is heated sufficiently to heat the coal particles 617 to a temperature preferably in the range of about 450° F.-650° F., preferably from about 500° F. to about 550° F. The pressure within the vessel 613 is essentially atmospheric, but could have a slight positive pressure if desired. While not required, a positive pressure offers the advantage of preventing air leakage into the reaction vessel 613 in cases where an oxygenated gas 606, 608 other than air is employed as a combustion gas. Fluidized bed zone pressure above 1000 psig are unnecessary.

Referring again to FIGS. 5 and 6, in step 52 of process 500, an oxygenated gas 606, 608 (such as atmospheric air) may be introduced via a line and at rates described elsewhere in this specification. In one embodiment, oxygenated gas is fed at the rate of three feet per second. In some embodiments, the process for deactivation of a porous partially dried coal material may comprise exposing the porous partially dried carbonaceous material, e.g. coal, to an oxygenated gas containing from about 6 volume percent to about 15 volume percent oxygen. In other embodiments, the oxygenated gas comprises 7 to 10 volume percent oxygen.

In step 54 of process 500, one may fluidize said bed of coal 617 with a mixture of heated oxygenated gas 606, 608 with an oxygen content of from about 6 to about 15 percent by volume and/or recycled-off gas 606 in a fluidized bed reactor 613. Step 54 may be performed by drawing in an oxygenated gas 606, 608, which may be air from the atmosphere, and feeding it into the fluidized bed reactor at a velocity below that which would cause the elutriation of fines from the reactor.

In a preferred embodiment, oxygenated gas 606, 608 is fed into the fluidized bed reactor 613 at a velocity of from about 1 to about 15 feet per second. In a preferred embodiment, oxygenated gas 606, 608 may be fed into the fluidized bed reactor 613 at a velocity of from about 1 to about 12.2 feet per second, fluidizing the reactor 613. In another preferred embodiment, oxygenated gas 606, 608 may be fed into the fluidized bed reactor 613 at a velocity of about 3 feet per second, fluidizing the reactor 613. As will be known to those skilled in the art, the velocity and oxygen content should be below levels that would create explosive hazards. It is to be understood that the velocity rates may vary according to the particular reactor used, the scale of the manufacturing process, and the reaction control dynamics of each process.

In step 56 of process 500, one may heat the atmospheric air 606, 608 with a propane flame to a temperature of from about 450 to about 650 degrees Fahrenheit. In another embodiment, a heat exchanger may be used to heat the atmospheric air. In one embodiment, the fluidized bed 613 may be heated to temperatures and by means described elsewhere in this specification. In other embodiments, the atmospheric air 606, 608 may be heated by other means known to those skilled in the art.

In one aspect of process 500, the oxygenated gas 606, 608 is heated by a propane flame. Fluidized bed 613 may be heated by a heat exchanger, and/or the hot coal, and/or the heat in a gas 606 fed from a separate reactor bed, and/or the combustion processes involved in said fluidized bed 613 (often referred to as "off gas"). As will be apparent, recycled oxygenated gas may be heated by the fluidized bed reactor 613, thus may be cooler than the heated oxygenated gas, and may be combined therewith and introduced into the reaction as an oxygenated combustion gas 606.

In step 57 of process 500, the heat generated by the combustion is absorbed by the partially dried coal material being fed into the system and is effective for drying the coal material to the desired level of 0.01-1.0%. The still partially-wet coal particles remain in the fluidized bed 617 for a time in the range of about one to about fifteen minutes, preferably from about three to about twelve minutes, more preferably from about four to about seven minutes.

Referring again to FIG. 6, water is removed from the coal in fluidized bed 613, and such coal is then discharged via line 654. In general, the water content of such coal is preferably less than about 1 weight percent. Generally, this is accomplished while maintaining said fluid bed at a density of from about 20 to about 50 pounds per cubic foot while removing water from said fluidized bed reactor 613.

Referring again to FIG. 6, the water removed from the coal in reactor 613 is fed via line 640 (together with "fines" and gas) to cyclone 642 and thence via line 644 to a condenser 646; the waste water from condenser 646 is then removed via line 650 and the gases are vented via line 648.

Referring again to FIGS. 5 and 6, in step 58 of process 500, the dried coal is separated from the combustion zone 617 whereby the coal product obtained is passivated and resistant to spontaneous combustion. The fines are removed from the reactor 638 via line 640. The solid product from cyclone 642 is then fed via line 652 and preferably blended with the dry coal from line 654.

Referring again to FIGS. 5 and 6, following drying, the coal is moved by conveyor and cooled to near ambient temperature such as by air or water circulation. Step 59 of process 500, cooling of the coal fines, may be performed by mixing the heated atmospheric air with a somewhat cooler recycled gas; passing the combination of gases through a cyclone to remove the solids; and transporting said solids to a downstream operation. In one embodiment depicted in FIG. 6, the blend is then fed to cooler 656, wherein it is preferably cooled to ambient temperature; and then is fed via line 658 to downstream operations such as packing with an inert case. In one embodiment, the passivated coal is sealed in a 55 gallon drum with $N_2$ gas.

In a preferred embodiment of process 500, the residence time of the coal is from about 4 to about 7 minutes. A particularly significant feature of the process of the invention is that most of all of the energy for drying the coal is generated in-situ and thus a highly efficient, economical process results and gives a very passivated coal product with less than 1% water content.

Thus, a novel process for producing a passivated coal material has been disclosed, comprising the steps of (a) drying a coal material by heating said coal material in the presence of a first gas comprised of less than about five volume percent of oxygen until said coal material has a moisture content of from about 0.01 to about 20 weight percent, thereby producing a partially dried coal material, wherein said coal material is selected from the group consisting of lignitic coal, sub-bituminous coal, bituminous coal, coal char, and mixtures thereof; (b) heating said partially dried coal material to a temperature of from about 100 to about 600 degrees Fahrenheit, thereby producing a heated partially dried coal material;

(c) charging said heated partially dried coal material to a fluidized bed reactor; (d) feeding a second gas with an oxygen content of from about 6 to about 15 volume percent into said fluidized bed reactor; (e) contacting said heated partially dried coal material with said second gas while maintaining said heated partially dried coal material at a temperature of from about 450 to about 650 degrees Fahrenheit; and, thereafter, (f) removing water from said heated partially dried coal material until no more than about 1 weight percent of water remains in said heated partially dried coal material.

The drying method of this invention can be accomplished either in (a) batch-wise manner such as in a fluidized bed in which conditions are changed successively, or (b) continuously be mechanically moving the material through drying steps, such as by a moving belt or screw conveyor. A continuous drying procedure is preferred for large capacity commercial drying applications for coal or lignite, such as those exceeding about 500 tons/day.

EXAMPLE 1

Wyodak coal from the Powder River Basin was mined. The raw particle size ranged from ¼ inch to ⅜ inch. This coal was dried for 4 minutes in a fluidized bed reactor at a temperature of 600 degrees Fahrenheit in the presence of air and recycled gas such that the combined gas had an oxygen content of about seven percent. The dried coal product had a moisture content of about ½ percent.

The passivated coal was allowed to sit for 30 days in an exposed outdoor storage structure (with a top) with relative humidity ranging from 37 to 78 per cent. The passivated coal absorbed water until the water content reached 2.5%, its water content equilibrium. The coal was subjected to temperatures ranging between 50 and 90 degrees Fahrenheit. No spontaneous combustion was observed.

Water was added to a portion of the passivated coal. The passivated coal absorbed water until the water content reached 2.5%, its water content equilibrium. The coal was subjected to temperatures ranging between 50 and 90 degrees Fahrenheit. No spontaneous combustion was observed.

I claim:

1. A process for producing a passivated coal material, comprising the steps of:

(a) drying a coal material by heating said coal material in the presence of a first gas comprised of less than about five volume percent of oxygen until said coal material has a moisture content of from above about 1 to about 20 weight percent, thereby producing a partially dried coal material, wherein said coal material is selected from the group consisting of lignitic coal, sub-bituminous coal, bituminous coal, coal char, and mixtures thereof;

(b) heating said partially dried coal material to a temperature of from about 100 to about 600 degrees Fahrenheit, thereby producing a heated partially dried coal material;

(c) charging said heated partially dried coal material to a fluidized bed reactor;

(d) feeding a second gas with an oxygen content of from about 6 to about 15 volume percent into said fluidized bed reactor;

(e) contacting said heated partially dried coal material with said second gas while maintaining said heated partially dried coal material at a temperature of from about 450 to about 650 degrees Fahrenheit; and, thereafter, (f) removing water from said heated partially dried coal material until no more than about 1 weight percent of water remains in said heated partially dried coal material.

2. The process for producing a passivated coal material as recited in claim 1, further comprising the step of simultaneously feeding said second gas into said fluidized bed reactor and maintaining said fluidized bed at a density of from about 20 to about 50 pounds per cubic foot while removing water from said fluidized bed reactor.

3. The process for producing a passivated coal material as recited in claim 1, wherein said second gas comprises from about 7 to about 10 volume percent oxygen.

4. The process for producing a passivated coal material as recited in claim 3, wherein said second gas comprises air.

5. The process for producing a passivated coal material as recited in claim 1, further comprising the step of heating said second gas prior to the time it is fed into said fluidized bed reactor.

6. The process for producing a passivated coal material as recited in claim 5, wherein said process further comprises the steps of combining said heated second gas with a third gas comprising from about 7 to about 10 volume percent oxygen and feeding said combined heated second gas and third gas into said fluidized bed reactor.

7. The process for producing a passivated coal material as recited in claim 6, wherein said third gas comprises recycled gas from said fluidized bed reactor.

8. The process for producing a passivated coal material as recited in claim 1, wherein said temperature in said fluidized bed reactor is from about 550 to about 600 degrees Fahrenheit.

9. The process for producing a passivated coal material as recited in claim 1, wherein said heated partially dried coal material is charged to the fluidized bed reactor at a rate of from about 0.01 to about 4000 pounds per hour.

10. The process for producing a passivated coal material as recited in claim 1, wherein said heated partially dried coal material is contacted with said second gas for about one to about fifteen minutes.

11. The process for producing a passivated coal material as recited in claim 10, wherein said heated partially dried coal material is contacted with said second gas for about four to about ten minutes.

12. The process for producing a passivated coal material as recited in claim 1, wherein said water is removed from said coal material until no more than from about 0.01 to about 1.0 weight percent of water remains in said coal material.

13. The process for producing a passivated coal material as recited in claim 1, wherein said second gas is fed into said fluidized bed reactor at a velocity of from about 3 to about 12.2 feet per second.

14. The process for producing a passivated coal material as recited in claim 6, wherein said second gas and said third gas are fed into said fluidized bed reactor at a velocity of from about 3 to about 12.2 feet per second.

15. The process for producing a passivated coal material as recited in claim 1, wherein said heated partially dried coal material is charged to the fluidized bed reactor at a rate of from about 100 to about 400 pounds per hour.

16. A process for producing a passivated coal material, comprising the steps of:

(a) drying a coal material by heating said coal material in the presence of a first gas comprised of less than about five volume percent of oxygen until said coal material has a moisture content of from above about 1 to about 20 weight percent, thereby producing a partially dried coal material, wherein said coal material is selected from the group consisting of lignitic coal, sub-bituminous coal, bituminous coal, coal char, and mixtures thereof, and wherein said coal material has a residual oxygen demand of about 10 to about 30;

(b) heating said partially dried coal material to a temperature of from about 100 to about 600 degrees Fahrenheit, thereby producing a heated partially dried coal material;

(c) charging said heated partially dried coal material to a fluidized bed reactor;

(d) heating a second gas with an oxygen content of from about 6 to about 15 volume percent via a heat exchanger;

(e) combining said heated second gas with a third gas with an oxygen content of from about 7 to about 10 volume percent and feeding said combined heated second gas and said third gases into said fluidized bed reactor;

(f) maintaining said fluidized bed at a density of from about 20 to about 50 pounds per cubic foot while removing water from said fluidized bed reactor;

(g) contacting said heated partially dried coal material with said second gas while maintaining said heated partially dried coal material at a temperature of from about 550 to about 650 degrees Fahrenheit; and, thereafter, (h) removing water from said heated partially dried coal material until no more than about 1 weight percent of water remains in said heated partially dried coal material.

17. The process for producing a passivated coal material as recited in claim 16, wherein said second gas is fed into said fluidized bed reactor at a velocity of from about 3 to about 12.2 feet per second.

18. The process for producing a passivated coal material as recited in claim 16, wherein said heated partially dried coal material is charged to said fluidized bed reactor at a rate of from about 0.01 to about 400 pounds per hour.

19. A process for producing a passivated coal material, comprising the steps of:

(a) drying a coal material by pyrolysis by heating said coal material in the presence of a first gas comprised of less than about five volume percent of oxygen until said coal material has a moisture content of from above about 1 to about 20 weight percent, thereby producing a partially dried coal material, wherein said coal material is selected from the group consisting of lignitic coal, subbituminous coal, bituminous coal, coal char, and mixtures thereof, and wherein said coal material has a residual oxygen demand of about 10 to about 30;

(b) heating said partially dried coal material to a temperature of from about 100 to about 600 degrees Fahrenheit, thereby producing a heated partially dried coal material;

(c) charging said heated partially dried coal material to a fluidized bed reactor at a rate of from about 0.01 to about 4000 pounds per hour;

(d) heating a second gas with an oxygen content of from about 6 to about 15 volume percent via a heat exchanger;

(e) combining said heated second gas with a third gas with an oxygen content of from about 7 to about 10 volume percent and feeding said combined heated second gas and said third gases into said fluidized bed reactor at a velocity of from about 3 to about 12.2 feet per second;

(f) maintaining said fluidized bed at a density of from about 20 to about 50 pounds per cubic foot while removing water from said fluidized bed reactor;

(g) contacting said heated partially dried coal material with said second gas while maintaining said heated partially dried coal material at a temperature of from about 550 to about 650 degrees Fahrenheit; and, thereafter, (h) removing water from said heated partially dried coal material for a period of from about one to about fifteen minutes until no more than about one weight percent of water remains in said heated partially dried coal material.

20. The process for producing a passivated coal material as recited in claim 19, wherein water is removed from said heated partially dried coal material for a period of from about four to about five minutes until no more than about 0.5 weight percent of water remains in said heated partially dried coal material.

* * * * *